US010557388B2

(12) United States Patent
Kawaguchi et al.

(10) Patent No.: US 10,557,388 B2
(45) Date of Patent: Feb. 11, 2020

(54) ENGINE EXHAUST VALVE FOR LARGE SHIP AND METHOD FOR MANUFACTURING THE SAME

(71) Applicant: DAIDO STEEL CO., LTD., Nagoya-shi (JP)

(72) Inventors: Shuhei Kawaguchi, Shibukawa (JP); Koichi Uno, Shibukawa (JP); Mototsugu Osaki, Shibukawa (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 455 days.

(21) Appl. No.: 15/003,641

(22) Filed: Jan. 21, 2016

(65) Prior Publication Data

US 2016/0215660 A1 Jul. 28, 2016

(30) Foreign Application Priority Data

Jan. 26, 2015 (JP) ..... 2015-012257
Oct. 14, 2015 (JP) ..... 2015-203272

(51) Int. Cl.
*F01L 3/04* (2006.01)

(52) U.S. Cl.
CPC ..... *F01L 3/04* (2013.01)

(58) Field of Classification Search
CPC ..... C22C 19/05; C22C 19/058; F01L 3/04
See application file for complete search history.

(56) References Cited

U.S. PATENT DOCUMENTS 3,969,109 A * 7/1976 Tanczyn ..... C22C 38/58 148/325
5,413,073 A 5/1995 Larson et al.
5,458,314 A 10/1995 Bonesteel
5,619,796 A 4/1997 Larson et al.
5,660,938 A * 8/1997 Sato ..... C22C 30/00 148/327
6,193,822 B1 * 2/2001 Nagashima ..... F01L 3/02 148/677
6,354,001 B1 3/2002 Asanuma
(Continued)

FOREIGN PATENT DOCUMENTS

CA 1038655 A 9/1978
CN 1048312 C 1/2000
(Continued)

OTHER PUBLICATIONS

Extended European Search Report dated Jun. 20, 2016.
(Continued)

*Primary Examiner* — Grant Moubry
*Assistant Examiner* — Ruben Picon-Feliciano
(74) *Attorney, Agent, or Firm* — McGinn I.P. Law Group, PLLC.

(57) ABSTRACT

The present invention relates to an exhaust valve of a diesel engine for a large ship, containing a shall part and an umbrella part that are integrated with each other and made of an Ni—Cr—Al system Ni-base age-precipitated alloy, in which the exhaust valve has a layered structure and hardness of 600 HV or less as a whole, and the layered structure contains a layer formed of an α-Cr phase having a thickness of 150 nm or more that is aged beyond peak mechanical strength.

10 Claims, 6 Drawing Sheets

(56) References Cited

U.S. PATENT DOCUMENTS

| | | | | |
|---|---|---|---|---|
| 6,491,769 | B1 * | 12/2002 | Smith | C22C 19/055 148/428 |
| 7,285,337 | B2 | 10/2007 | Narita et al. | |
| 9,464,730 | B2 | 10/2016 | Bihlet | |
| 9,714,724 | B2 | 7/2017 | Bihlet | |
| 2005/0153161 | A1 | 7/2005 | Narita et al. | |
| 2014/0008562 | A1 * | 1/2014 | Bihlet | F01L 3/04 251/368 |
| 2015/0292052 | A1 * | 10/2015 | Takeda | C21D 9/60 267/166 |
| 2015/0337694 | A1 | 11/2015 | Bihlet | |

FOREIGN PATENT DOCUMENTS

| | | | |
|---|---|---|---|
| CN | 1310287 | A | 8/2001 |
| CN | 101429608 | A | 5/2009 |
| CN | 103527281 | A | 1/2014 |
| EP | 0 889 207 | A1 | 1/1999 |
| EP | 1 493 844 | A1 | 1/2005 |
| JP | 2000-328163 | A | 11/2000 |
| JP | 2009-263736 | A | 11/2009 |
| JP | 2012-45604 | A | 3/2012 |
| JP | 2014-169631 | A | 9/2014 |
| WO | WO 02/092865 | A1 | 11/2002 |

OTHER PUBLICATIONS

Chinese Office Action dated Jun. 19, 2018 in corresponding Chinese Application No. 2016100528172 with an English translation thereof.

Korean Office Action, dated Aug. 19, 2019, in Korean Application No. 10-2016-0007877 and English Translation thereof.

Japanese Office Action, dated Jun. 4, 2019, in Japanese Patent Application No. 2015-203272 and English Translation thereof.

* cited by examiner

ENGINE EXHAUST VALVE FOR LARGE SHIP AND METHOD FOR MANUFACTURING THE SAME

FIELD OF THE INVENTION

The present invention relates to an engine exhaust valve used in a diesel engine for a large ship and a method for manufacturing the same. Particularly, the present invention relates to an engine exhaust valve for a large ship, containing an Ni—Cr—Al system. Ni-base age-precipitated alloy, and a method for manufacturing the same.

BACKGROUND ART OF THE INVENTION

Diesel engine for a large ship mainly uses heavy oil as a fuel, and thus, an exhaust gas discharged from a combustion chamber of the engine contains a large amount of highly corrosive sulfide and the like. For this reason, in an exhaust valve is used a metal material that is highly resistant to high temperature corrosion called S attack or V attack, which is caused by the contact with such an exhaust gas flow. As examples of a material having excellent high temperature corrosion resistance, known are an Ni—Cr—Al system Ni-base alloy such as Nimonic 80A and Inconel 718, and a Co-base alloy such as Stellite ("Nimonic", "Inconel" and "Stellite" are registered trademarks).

An exhaust valve of a diesel engine has a shaft part and an umbrella part (disc part) including a fire contact surface and a seat surface. The umbrella part is required to have high toughness such as corrosion resistance and abrasion resistance in high temperature environment. On the other hand, it is considered preferable that the shaft part has a certain degree of machinability for incorporating in an engine, that is, has a toughness not increased so much. For this reason, there has been proposed a hybrid-type engine valve using such a high corrosion resistance alloy in only an umbrella part. On the other hand, considering easiness of manufacturing, an integrated exhaust valve having a shaft part and an umbrella part that are integrated with each other is advantageous, and there has been also proposed a gradient material type integrated exhaust valve in which mechanical properties have been adjusted in each of its shaft part and umbrella part.

For example, Patent Document 1 discloses an integrated exhaust valve, as an exhaust valve for a diesel engine, in which its mechanical strength has been partially increased by applying cold working to a face surface of an umbrella part by using an Ni—Cr—Al system alloy which contains Cr in an amount larger than that of Nimonic 80A containing about 20% of Cr and has excellent high temperature corrosion resistance. In detail, an outline of the exhaust valve is obtained by using an Ni-base alloy having a component composition of, in % by weight, C: ≤0.1%, Si: ≤1.0%, Mn: ≤1.0%, Cr: more than 25 to 32%, Ti: more than 2.0 to 3.0%, Al: 1.0 to 2.0% and Co: 12 to 20%, and cold working is then applied to a face surface of its umbrella part, thereby partially increasing mechanical strength of the face surface.

Patent Document 2 discloses an integrated exhaust valve in which mechanical strength of a site requiring mechanical strength has been partially increased by build-up welding, as an exhaust valve for a middle or high speed type diesel engine used in a small ship or a power generator. In Patent Document 2, an umbrella part is formed by die forging by using a precipitation-hardened Ni—Cr—Al system alloy to obtain an outline of an exhaust valve including a shaft part, and a first heat treatment is applied to the exhaust valve until exceeding a peak of mechanical strength (mainly hardness) and softening, that is, until reaching so-called overaging. A face surface of the umbrella part is subjected to grooving, build-up welding is performed thereon, and a second heat treatment is then performed. As a result, the shaft part has been overaged, and thus, hardness thereof is reduced than a peak value, and additionally machinability is improved. This facilitates cutting performed according to the need such as an engine mounting process. On the other hand, a build-up welded part on the face surface can be improved in corrosion resistance at high temperature by the second heat treatment. As a result, sealing properties can be enhanced.

Patent Document 1: JP-A-2000-328163

Patent Document 2: JP-A-2014-169631

SUMMARY OF THE INVENTION

As described above, in an exhaust valve having a shaft part and an umbrella part that are integrated with each other, in the case where mechanical strength required in the umbrella part is given to the shaft part as it is, it becomes difficult to secure workability necessary in the processing of the shaft part required according to the need such as an engine mounting process. In contrast, in the case where mechanical properties are adjusted in the shaft part and the umbrella part separately by applying partial cold working or welding, the production process tends to become complicated, leading to the increase of production costs.

The present invention has been made in view of the above circumstances, and an object of the present invention is to provide an easily manufacturable engine exhaust valve for a large ship, which is an exhaust valve having a shaft part and an umbrella part that are integrated with each other, and to provide a method for manufacturing the same.

The engine exhaust valve for a large ship according to the present invention is an exhaust valve of a diesel engine for a large ship, containing a shaft part and an umbrella part that are integrated with each other and made of an Ni—Cr—Al system Ni-base age-precipitated alloy, in which the exhaust valve has a layered structure and hardness of 600 HV or less as a whole, and the layered structure contains a layer formed of an os-Cr phase having a thickness of 150 nm or more that is aged beyond peak mechanical strength.

According to this invention, although the engine exhaust valve for a large ship is an exhaust valve having a shaft part and an umbrella part that are integrated with each other, the exhaust valve has sufficient mechanical strength, and at the same time, machinability in a shaft part is achieved. In other words, this exhaust valve has mechanical strength equivalent to or more than that of a conventional exhaust valve made of Nimonic 80A, and also has machinability of the shaft part.

In the invention described above, the alloy may have a component composition containing, in mass %:

essential elements of
Cr: 32 to 50%,
Al: 0.5 to 10.0%, and
Fe: 0.1 to 20.0%,
optional elements of
Si: 5% or less,
B: 0.01% or less,
C: 0.1% or less,
Cu: 5% or less,
Ti: 0.1% or less,
Nb: 0.1% or less, Ta: 0.1% or less, and V: 0.1% or less, with the proviso that Ti+Nb+Ta+V is 0.1% or less, and the balance being unavoidable impurities and Ni.

According to this aspect, high temperature corrosion resistance is also achieved in addition to mechanical strength equivalent to or more than that of a conventional exhaust valve made of Nimonic 80A and machinability of the shaft part.

The method for manufacturing an engine exhaust valve for a large ship according to the present invention is a method for manufacturing an exhaust valve of a diesel engine for a large ship, containing a shaft part and an umbrella part that are integrated with each other and made of an Ni—Cr—Al system Ni-base age-precipitated alloy, in which the method contains:

a melting step of vacuum melting a raw material to obtain a steel ingot, a billeting step of obtaining a billet for forge working from the steel ingot, an aging heat treatment step of subjecting the billet to an aging heat treatment beyond peak mechanical strength so as to give a layered structure containing a layer formed of an α-Cr phase having a thickness of 150 nm or more, a forge-working step of forge-working the billet in an integrated state of the shaft part and umbrella part, and an adjusting heat treatment step of giving hardness of 600 HV or less as a whole while maintaining the thickness of the layer formed of the α-Cr phase, and in which steps of from the melting step to the aging heat treatment step are conducted while maintaining the temperature to at least 600° C. or higher.

According to this invention, the method provides an engine exhaust valve for a large ship, having sufficient mechanical strength and at the same time having machinability in a shaft part without including a complicated step, although the exhaust valve is an exhaust valve containing a shaft part and a umbrella part that are integrated with each other. In other words, this method gives mechanical strength comparable to that of a conventional exhaust valve made of Nimonic 80A to an engine exhaust valve and machinability to a shaft part, without including a partial working step for improving mechanical strength of a part of the valve.

In the invention described above, the billeting step may contain subjecting the steel ingot to pre-rolling, to hot surface grinding and then, to main rolling.

According to this aspect, this method can prevent cracking during manufacturing, and additionally can give mechanical strength comparable to that of a conventional exhaust valve made of Nimonic 80A to an engine exhaust valve and machinability to a shaft part, without including a partial working step for improving mechanical strength of a part of the valve.

In the invention described above, the alloy may have a component composition containing, in mass %:

essential elements of

Cr: 32 to 50%,

Al: 0.5 to 10.0%, and

Fe: 0.1 to 20.0%, optional elements of

Si: 5% or less,

B: 0.01% or less,

C: 0.1% or less,

Cu: 5% or less,

Ti: 0.1% or less,

Nb: 0.1% or less,

Ta: 0.1% or less, and

V: 0.1% or less, with the proviso that Ti+Nb+Ta+V is 0.1% or less, and the balance being unavoidable impurities and Ni.

According to this aspect, this method can provide an exhaust valve having high temperature corrosion resistance in addition to mechanical strength equivalent to or more than that of a conventional exhaust valve made of Nimonic 80A and machinability of the shaft part, without including a complicated step.

In the invention described above, the billeting step may contain a heat equalizing treatment step of maintaining the steel ingot at 1,100° C. or higher for 10 hours or more as a first step.

Furthermore, in the invention described above, the billeting step may be conducted while maintaining the temperature at 800° C. or higher.

According to these aspects, this method can prevent cracking during billeting without excessively increasing deformation resistance of the steel ingot or billet in the billeting step, and additionally can give mechanical strength comparable to that of a conventional exhaust valve made of Nimonic 80A to an engine exhaust valve and machinability to a shaft part, without including a partial working step for improving mechanical strength of apart of the valve.

The present invention also encompasses the exhaust valve of a diesel engine for a large ship that is an exhaust valve, containing a shaft part and an umbrella part that are integrated with each other and made of an Ni—Cr—Al system Ni-base age-precipitated alloy, in which the exhaust valve is obtained by one of the manufacturing methods described above, and has a layered structure and hardness of 600 FIV or less as a whole, in which the layered structure contains a layer formed of an α-Cr phase having a thickness of 150 nm or more that is aged beyond peak mechanical strength.

According to this invention, the exhaust valve is obtained by the manufacturing process in which cracking is prevented, and this exhaust valve has mechanical strength equivalent to or more than that of a conventional exhaust valve made of Nimonic 80A, and also has machinability of the shaft part.

DETAILED DESCRIPTION OF THE INVENTION

An exhaust valve of a diesel engine is described below as one example of the present invention, by reference to FIG. 1.

Figure 1:
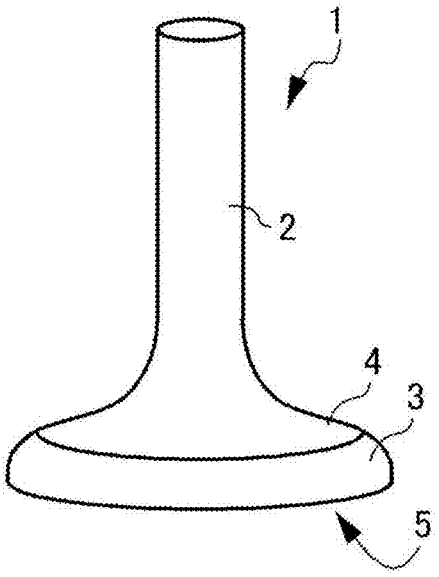
FIG. 1 is a perspective view of an exhaust valve.

As illustrated in FIG. 1, an exhaust valve 1 is a diesel engine exhaust valve for a ship, which is made of an Ni—Cr—Al system Ni-base age-precipitated alloy having excellent high temperature corrosion resistance. The exhaust valve 1 contains a shaft part 2 and an umbrella part 3 that are integrated with each other, which is integrally formed by giving the umbrella part 3 to a tip of the rod-shaped shaft part 2 by forging or the like. The umbrella part 3 is provided with a face surface 4 having a curved surface at a side of the shaft part 2, and a fire contact surface 5 opposite thereto.

The Ni-base age-precipitated alloy gives a layered structure (a lamellar structure) containing a layer formed of an α-Cr phase in crystal grains by a given aging heat treatment. Even in the exhaust valve 1, the layered structure containing a layer formed of an α-Cr phase having a thickness of 150 nm or more in crystal grains is observed as a whole. This is described below. In the peak of mechanical strength by the aging heat treatment, the thickness (width) of the layer formed of an α-Cr phase is about 150 nm. In other words, the exhaust valve 1 is in an overaged state and has hardness decreased from peak strength to 600 HV or less. Therefore, the shaft part 2 has machinability necessary for incorporating in an engine, and at the same time, the exhaust valve 1 achieves mechanical strength equivalent to or more than that of an exhaust valve made of Nimonic 80A while securing workability.

The Ni-base age-precipitated alloy may have a component composition containing: Cr: 32 to 50%, Al; 0.5 to 10.0% and Fe; 0.1 to 20.0%, in mass %, in Ni. Typically, the Ni-base age-precipitated alloy contains Ni: 57%, Cr: 38%, Fe: 0.5% or less, and Al: 3.8%. In this component composition, the alloy exhibits a layered structure containing a layer formed of an α-Cr phase in crystal grains by an aging heat treatment at 930° C. or lower, and can give predetermined mechanical strength as an exhaust valve when γ'-phase has been precipitated and grown to make overaging.

The Ni-base age-precipitated alloy having the above-described component composition exhibits S attack resistance corrosion weight loss, which is an index of high temperature corrosion resistance, smaller than, for example, that of Nimonic 80A and Inconel 718, and comparable to that of Inconel 625. The Ni-base age-precipitated alloy having the above-described component composition exhibits V attach resistance corrosion weight loss smaller than that of each of those three alloys. Incidentally, S attach resistance and V attach resistance do not almost depend on hardness. The above component composition can contain optional addition elements without greatly inhibiting mechanical strength, corrosion resistance and the like, and this is described hereinafter.

A method for manufacturing the above-described exhaust valve 1 is described below by reference to FIGS. 2, 3, 4A, 4B and 8.

Figure 2:
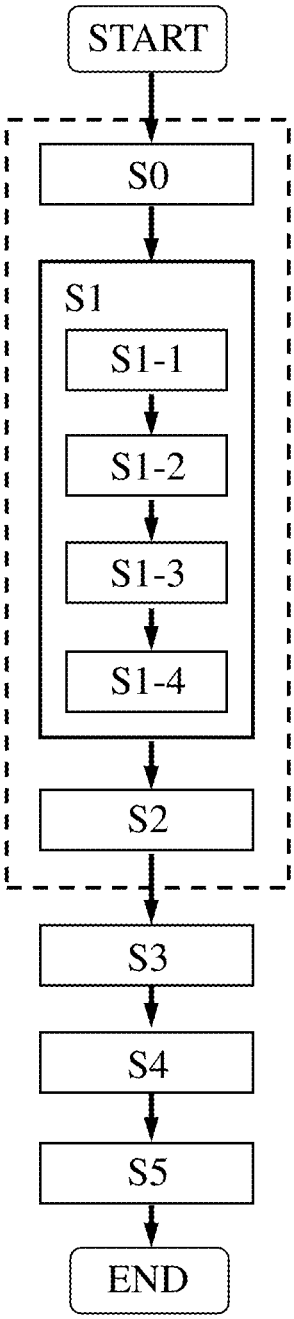
FIG. 2 is a process chart showing a method for manufacturing an exhaust valve according to the present invention.

Referring to FIG. 2, first, a steel ingot made of an Ni-base alloy having a predetermined component composition is melted in a vacuum induction furnace (S0). The steel ingot after melting is shaped with a mold before decreasing the temperature, and is conveyed while maintaining the temperature at 600° C. or higher and placed in a heat equalizing furnace for rolling. In order to maintain the temperature, conveying work may be conducted in a short period of time, or, for example, the steel ingot is covered with a sheet-shaped or box-shaped heat-insulating material made of a refractory such as ceramic fiber just after shaping with a mold, and suppressed the decrease of the temperature of a steel ingot surface during conveying to the heat equalizing furnace, thereby maintaining the temperature.

Subsequently, the steel ingot is subjected to blooming as necessary, and a billet for forge working is produced therefrom by rolling (S1). In Particular, in the case of producing an exhaust valve having a diameter of a shaft part of 60 min or more as used in a diesel engine for a large ship, a diameter of the billet is made larger than 100 mm.

In the billeting (S1), the steel ingot may be subjected to a heat equalizing treatment for the rolling in a heat equalizing furnace (S1-1). In the heat equalizing treatment, the steel ingot is typically heated and maintained at a temperature of 1,100° C. or higher for 10 hours or more. Preferably, the steel ingot is heated to 1,150° C. Then, the steel ingot heated and maintained may be pre-rolled (S1-2). In the pre-rolling, the steel ingot is subjected to blooming as necessary, and is rolled in a working amount smaller than that of main rolling described hereinafter. Subsequently, the pre-rolled steel ingot is subjected to hot surface grinding in order to remove scratches on the surface generated in the pre-rolling (S1-3). The steel ingot is then subjected to main rolling to obtain a billet (S1-4). In each of the pre-rolling (S1-2), the surface grinding (S1-3) and the main rolling (S1-4), the temperature is maintained higher than a forging completion temperature. The forging completion temperature is typically 800° C. or higher, and is preferably about 850° C. The steel ingot may be reheated in the heat equalizing furnace as necessary in order to maintain the temperature. Furthermore, for the purpose of maintaining the temperature, for example, the circumference of the steel ingot or bloomed steel piece may be covered with a heat-insulting material such as ceramic fiber and conveyed to rolling facilities, or the rolling may be conducted in the form that the steel ingot or bloomed steel piece is covered with the heat-insulating material, thereby suppressing the decrease of a surface temperature of the steel ingot or bloomed steel piece during rolling.

Figure 8:
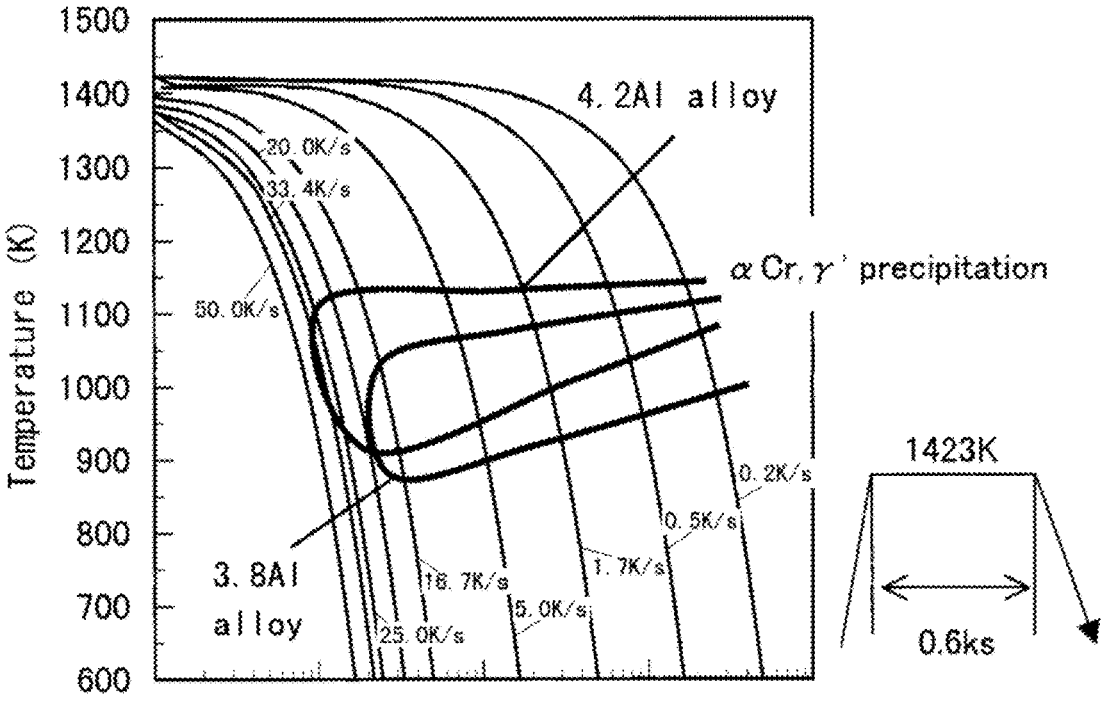
FIG. 8 is a graph showing CCT (Continuous Cooling Transformation) curves of Ni—Cr—Al system Ni-base age-precipitated alloys.

Particularly, referring to FIG. 2 in conjunction with FIG. 8, in conveying the steel ingot to a heat equalizing furnace for rolling after melting (S0), the temperature of the steel ingot is maintained at 600° C. (873K) or higher to decrease temperature difference between a surface part and an inside, thereby preventing cracking of the steel ingot. In this conveyance after melting (S0), γ'-phase may be precipitated in the vicinity of the surface of the steel ingot. However, the precipitation of γ'-phase is suppressed particularly in the inside of the steel ingot by suppressing the decrease of temperature as a whole steel ingot. Furthermore, in the billeting (S1), the precipitation of γ'-phase can be prevented in the heat equalizing treatment (S1-1) at a temperature of 1,100° C. (1,373K) or higher, and the precipitation of γ'-phase in the inside of a steel ingot or steel piece can be suppressed in the pre-rolling (S1-2), the surface grinding (S1-3) and the main rolling (S1-4), in all of which the temperature is maintained at 800° C. (1,073K) or higher. Accordingly, the cracking of a steel ingot or steel piece can be prevented without excessively increasing deformation resistance during rolling. Furthermore, the cracking of a steel ingot or steel piece can be prevented also by the removal of scratches with the surface grinding (S1-3). The billet can be thus prepared.

Subsequently, the billet prepared is subjected to an aging heat treatment (S2). If the billet is directly air-cooled, cracking tends to be generated. Therefore, it is preferred that the billet is directly maintained at a temperature of the aging heat treatment. In other words, the aging heat treatment is conducted while maintaining the temperature at 600° C. or higher that is a temperature maintained from the melting step (S0) to the billeting step (S1) as described above, preferably at 800° C. or higher that is a rolling completion temperature. In the aging heat treatment step (S2), the aging heat treatment is further conducted beyond a peak of mechanical strength (e.g., corresponding to hardness of about 700 HV) which is attained by age precipitation of reinforced particles (γ'-phase) in the age-precipitated alloy. That is, overaged state is formed. The hardness of the valve is adjusted to 600 HV or less by an adjusting heat treatment (S5) described below. A layered structure containing a layer formed of an α-Cr phase having a thickness of about 150 nm is observed in structure in crystal grains observed by cross-sectional observation in the billet at a peak of mechanical strength. Therefore, in the case where the aging heat treatment is conducted beyond this state, the thickness of the layer of α-Cr phase greatly grows. The aging heat treatment is typically conducted by maintaining the billet at about 850° C. for about 16 hours, followed by air-cooling.

Figure 3:
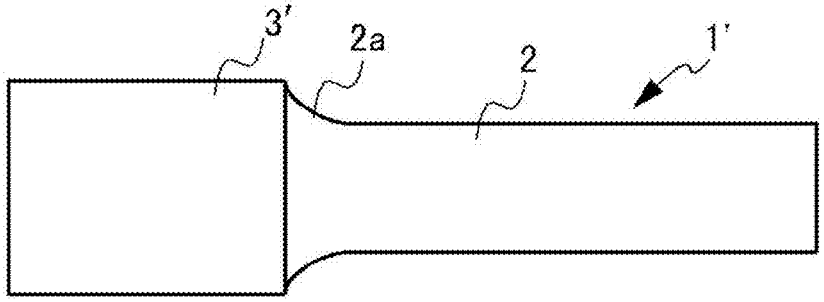
FIG. 3 is a side view illustrating a forged steel material in one step of a method for manufacturing an exhaust valve.

Next, as illustrated in FIG. 3, a stepped round bar 1' is prepared by hot forging (rough forging) typically at a heating temperature of about 1,050° C. (S3). The stepped round bar 1' is a bar-shaped product containing a round bar-shaped shaft part 2, a connecting part 2*a* having a diameter continuously increasing from the round bar-shaped shaft part 2, and a worked part 3' having a diameter larger than that of the shaft part 2 in the tip of the connecting part 2*a*. The stepped round bar 1' may be subjected to machining as necessary.

Next, the stepped round bar 1 is shaped and forge-worked typically at a heating temperature of about 1,050° C. to deform the worked part 3', thereby giving an umbrella part 3, and is worked into nearly valve shape where the shaft part and the umbrella part are integrated (S4).

Figure 4A:
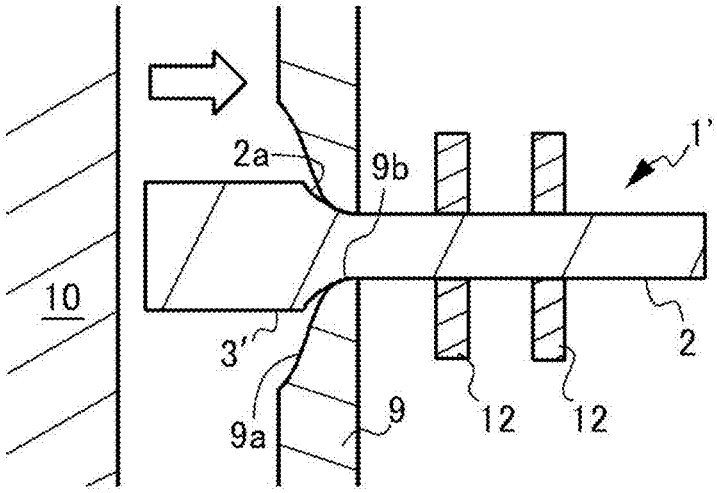
FIG. 4A and FIG. 4B are a cross-sectional views illustrating one step of a method for manufacturing an exhaust valve.
Figure 4B:
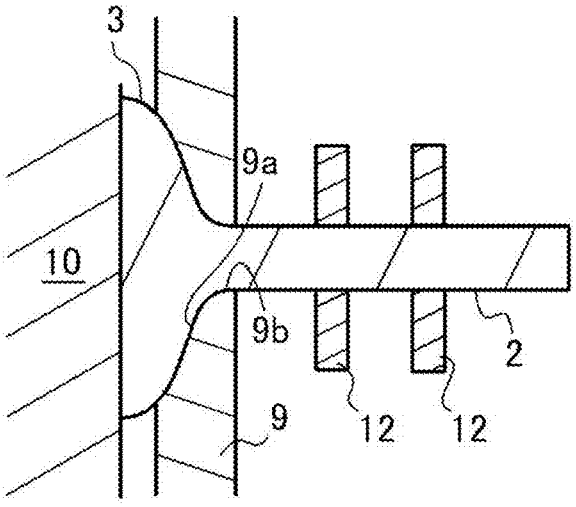

In detail, as illustrated in FIG. 4A, first, a forging die 9 which has a worked surface 9*a* formed so as to correspond to a curved surface at a side of the face surface 4 of the umbrella part 3 of the exhaust valve 1 to be obtained is prepared. The shaft part 2 of the stepped round bar 1' is inserted in a central penetration hole 9*b* of the forging die 9 from a side of the worked surface 9*a*. The shaft part 2 is held by a holder 12, and is pushed until at least a part of the connecting part 2*a* comes into contact with the worked surface 9*a* of the forging die 9. As illustrated in FIG. 4B, the end of the working part 3' to be worked comes into contact with an anvil 10, and the forging die 9 is made approach to the anvil 10 along a shaft axis of the stepped round bar 1' to conduct the shaping and forge working. As a result, a valve-shaped material having the umbrella part 3 can be obtained.

Next, the valve-shaped material obtained is placed in an external heating furnace and subjected to a heat treatment of typically maintaining at about 800° C. for about 21 hours, followed by air-cooling, thereby performing an adjusting heat treatment for adjusting the structure, mainly hardness (S5). In this heat treatment, the valve-shaped material is subjected to overaging heat treatment in conjunction with the aging heat treatment (averaging treatment (S2)), that is, the valve-shaped material is softened until it reaches a mechanical strength exceeding its peak and reaches a predetermined hardness. In this case, the layered structure in crystal grains, containing a layer formed of an α-Cr phase having a thickness of 150 nm or more and obtained by the aging heat treatment (S2) is maintained. The predetermined hardness is 600 HV or less, and preferably from 380 HV to 430 HV. By adjusting the hardness as above, mechanical strength equivalent to or more than that of a conventional exhaust valve made of Nimonic 80A and machinability can be given to the valve-shaped material.

In the manufacturing method according to the present invention, it is preferred to conduct a solution heat treatment that makes precipitates such as carbide or an intermetallic compound solid-dissolve, prior to the adjusting heat treatment (S5). Typically, the valve-shaped material is maintained at about 1,050° C. for about 1 hour, followed by water-cooling.

(Evaluation Test)

Evaluation test conducted by manufacturing the exhaust valve 1 obtained by the manufacturing method described above is described below.

First, a steel ingot made of a Ni—Cr—Al system Ni-base age-precipitated alloy having the component composition shown in Table 1 was cast, and the exhaust valve 1 was manufactured by the manufacturing method described above.

TABLE 1

| | Component Analysis | | | | | | | | | |
|---|---|---|---|---|---|---|---|---|---|---|
| | Cr | Al | Fe | Si | C | B | Cu | Ti | Nb | Ni |
| mass % | 38.39 | 3.87 | 0.30 | 0.04 | 0.014 | 0.0036 | 0.01 | 0.01 | 0.03 | 57.15 |

Total four (4) kinds of exhaust valves 1 were manufactured by applying 4 kinds of heat treatment histories. That is, exhaust valves 1 were manufactured by previously conducting or not the solution heat treatment before the adjusting heat treatment (aging heat treatment (S5)), and in either case, conducting the adjusting heat treatment (aging heat treatment (S5)) by maintaining at 800° C. for 16 hours or maintaining at 800° C. for 21 hours.

In the evaluation test, a tensile test piece was cut off along a longitudinal direction from the vicinity of an end of the shaft part 2 (a side opposite the umbrella part 3) of each exhaust valve 1, and additionally in Examples 1 and 2 described hereinafter, a tensile test piece was further cut off along a circumferential direction from the vicinity of an outer circumference of the umbrella part 3. Those test pieces were subjected to a tensile test at ordinary temperatures. Furthermore, a hardness test piece was cut off from a shoulder remaining material of each tensile test piece, and Brinell hardness and Vickers hardness of the hardness test piece were measured. The Vickers hardness test was conducted at five points on a polished surface of a mirror-polished test piece at ordinary temperatures, and its average value was used as a measurement value. Those test results are shown in Table 2. In "Treatment condition" of Table 2, "AG" indicates that the aging heat treatment (S5) was conducted without conducting a solution heat treatment, "ST-AG" indicates that the solution heat treatment was conducted before the aging heat treatment (S5) was conducted, "/16" indicates that the holding time in the aging heat treatment (S5) was 16 hours, and "/21" indicates that the holding time thereof was 21 hours. That is, the holding time in the aging heat treatment (S5) was 21 hours in Examples 1 and 2, and was 16 hours in Examples 3 and 4. Sectional structure of the shoulder remaining material of the hardness test piece was observed as described hereinafter.

| No. | Treatment condition | Part | Target value | 0.2% Proof stress ≥800 (N/mm$^2$) | Tensile strength ≥1200 (N/mm$^2$) | Elongation ≥7 (%) | Reduction of area ≥7 (%) | Hardness ≥352 (HBW) | Hardness 380-430 (HV) |
|---|---|---|---|---|---|---|---|---|---|
| Example 1 | AG/21 | shaft | Measured | 1089 | 1395 | 21 | 38 | 371 | 390 |
| | | umbrella | value | 1065 | 1347 | 23 | 33 | 371 | 397 |
| Example 2 | ST-AG/21 | shaft | | 1132 | 1448 | 22 | 36 | 400 | 414 |
| | | umbrella | | 1136 | 1452 | 17 | 25 | 400 | 425 |
| Example 3 | AG/16 | shaft | | 1181 | 1475 | 8 | 14 | 429 | not conducted |
| Example 4 | ST-AG/16 | shaft | | 1156 | 1457 | 16 | 19 | 429 | not conducted |

Nimonic 80A typically has a 0.2% proof stress of 800 N/mm$^2$ or more, and a tensile strength of 1,200 N/mm$^2$ or more. Therefore, those values were used as target values of 0.2% proof stress and tensile strength in the tensile test. Further, considering machinability required in the shaft part, it is sufficient if elongation is 5% or more and reduction of area is 5% or more. The elongation is preferably 7% or more and the reduction of area is preferably 7% or more. Therefore, those values were used as target values. The elongation is more preferably 15% or more and the reduction of area is more preferably 25% or more. The target value of hardness was set as a range of from 380 to 430 HV as Vickers hardness and as 352 HBW or more as Brinell hardness, in order to achieve more preferably workability as a shaft part of an exhaust valve and additionally considering abrasion resistance as an umbrella part.

Referring to Table 2, in each example, all of the results of tensile test and the results of hardness test satisfied the target values. In other words, in the above examples, the hardness can be adjusted to within a range of from 380 to 430 HV, and mechanical strength required as an exhaust valve can be obtained while securing preferable workability as a shaft part of an exhaust valve.

Particularly, elongation and reduction of area were greatly improved in Examples 1 and 2 in which the exhaust valve was maintained isothermally for 21 hours in the aging heat treatment (S5) as compared with Examples 3 and 4 in which the exhaust valve was maintained for 16 hours in the aging heat treatment (S5). Furthermore, 0.2% proof stress and tensile strength in Examples 1 and 2 were slightly decreased as compared with Examples 3 and 4, but are sufficient to the target values.

The umbrella part 3 showed higher hardness (Vickers hardness) than that of the shaft part 2. In other words, the umbrella part 3 in Example 1 showed a hardness of 397 HV, which was higher than 390 HV of the shaft part 2. The umbrella part 3 in Example 2 showed a hardness of 425 HV, which was higher than 414 HV of the shaft part 2. The reason for this is considered that because shaping and forging are conducted in the umbrella part 3, hardness of the umbrella part 3 can be increased.

The exhaust valves of Examples 1 and 2 were manufactured by isothermally holding the exhaust valves for 21 hours in the aging heat treatment of the adjusting heat treatment (S5). As for each of these exhaust valves of Examples 1 and 2, a high temperature tensile test piece was further cut off from the end of the shaft part 2 that was cut off from the tensile test piece, and was subjected to a high temperature tensile test. The test was conducted by holding the high temperature tensile test piece at 500° C. for 20 minutes and then applying a load. The results of the high temperature tensile test are shown in Table 3.

TABLE 3

| No. | Treatment condition | 0.2% Proof stress (N/mm$^2$) | Tensile strength (N/mm$^2$) | Elongation (%) | Reduction of area (%) |
|---|---|---|---|---|---|
| Example 1 | AG/21 | 755 | 1048 | 22 | 34 |
| Example 2 | ST-AG/21 | 936 | 1213 | 9 | 9 |

Figure 5A:
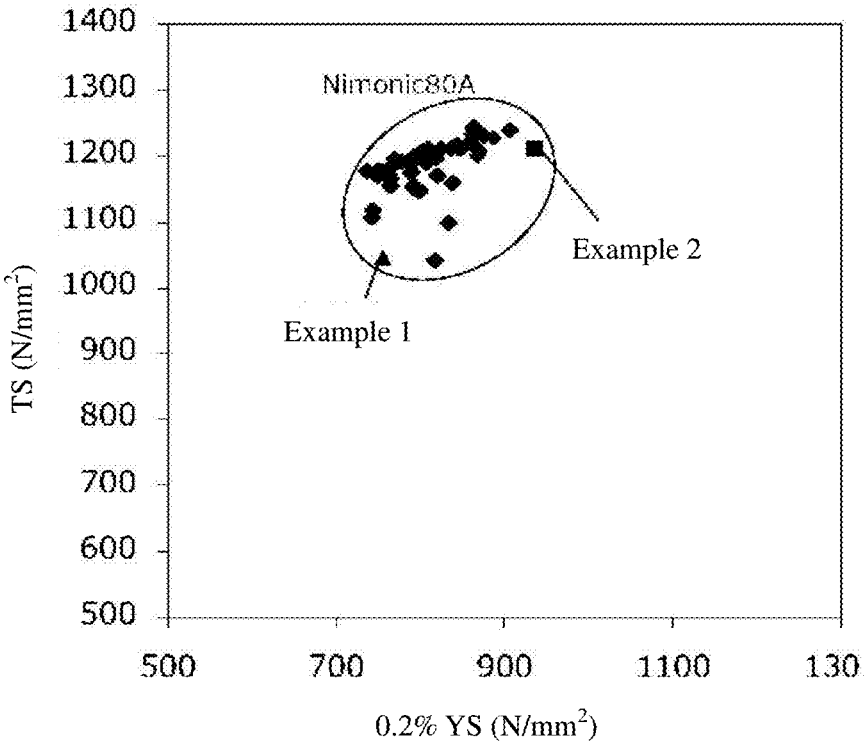
FIG. 5A and FIG. 5B are graphs showing the results of a high temperature tensile test of an exhaust valve in Example 1 and 2 according to the present invention.
Figure 5B:
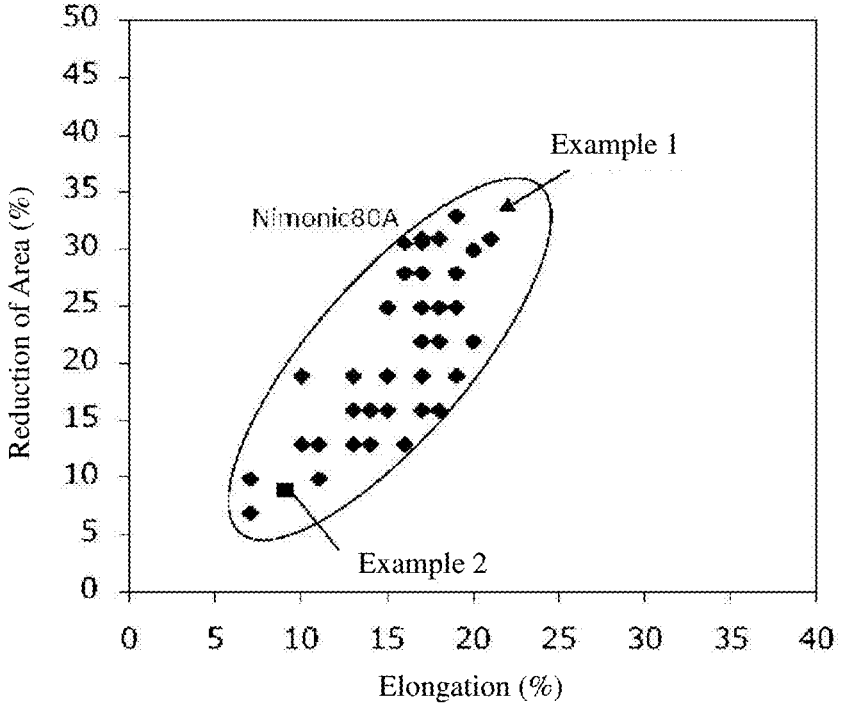

Referring to Table 3 in conjunction with FIG. 5A and FIG. 5B, the test results of Examples 1 and 2 were within the same degree of the variation range of the test results of the exhaust valve made of Nimonic 80A tested under the same conditions. In other words, the exhaust valves of Examples 1 and 2 showed 0.2% proof stress, tensile strength, elongation, and reduction of area, which are equivalent to or more than that of the exhaust valve made of Nimonic 80A. In detail, the exhaust valve made of Nimonic 80A showed 0.2% proof stress distributing in a range of from about 740 to 910 N/mm$^2$, whereas the exhaust valves of Examples 1 and 2 showed 755 N/mm$^2$ and 936 N/mm$^2$, respectively, which were equivalent to or more than that of the exhaust valve made of Nimonic 80A. Similarly, the exhaust valve made of Nimonic 80A showed tensile strength distributing in a range of from about 1,040 to 1,240 N/mm$^2$, whereas the exhaust valves of Examples 1 and 2 showed 1,048 N/mm$^2$ and 1,213 N/mm$^2$, respectively, which were equivalent to that of the exhaust valve made of Nimonic 80A. Furthermore, the exhaust valve made of Nimonic 80A showed elongation of distributing in a range of from about 7 to 21%, whereas the exhaust valves of Examples 1 and 2 showed 22% and 9%, respectively, which were equivalent to or more than that of the exhaust valve made of Nimonic 80A. Additionally, the exhaust valve made of Nimonic 80A showed reduction of area distributing in a range of from about 7 to 33%, whereas the exhaust valves of Examples 1 and 2 showed 34% and 9%, respectively, which were equivalent to or more than that of the exhaust valve made of Nimonic 80A. In other words, it is understood that according to Examples 1 and 2, the exhaust valve of the present invention also achieves high temperature tensile strength equivalent to or more than that of the exhaust valve made of Nimonic 80A.

Figure 6A:
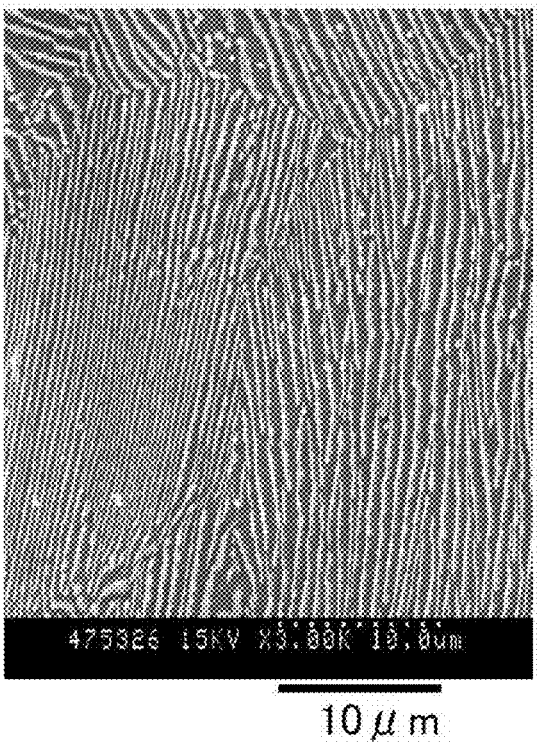
FIG. 6A and FIG. 6B are a cross-sectional structure photographs (scanning electron microscope: SEM) of an exhaust valve when showing peak mechanical strength.
Figure 6B:
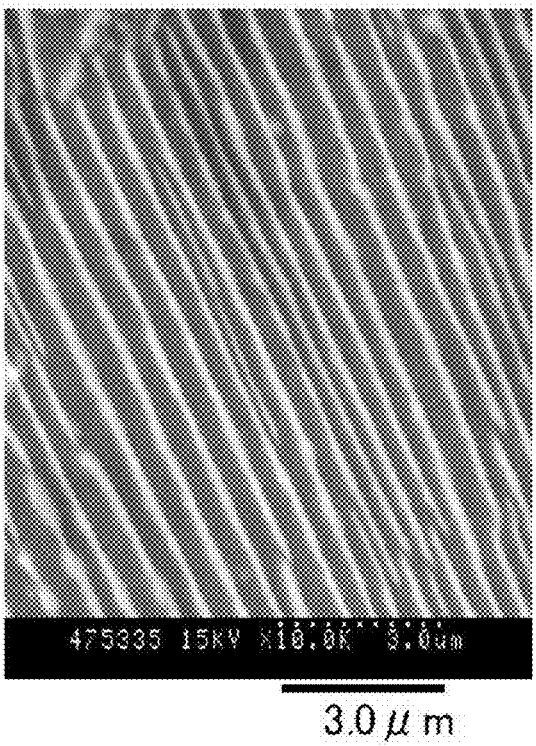

FIG. 6A and FIG. 6B show SEM observation photographs of a sectional structure of the exhaust valve made of the alloy used in the Examples described above at the time when the exhaust valve reached peak mechanical strength, that is when the hardness was about 700 HV. The observation was performed on a surface formed by mirror-polishing the cut surface and etching the surface with 10% oxalic acid solution. As is apparent from these SEM observation photographs, a layered structure containing a layer formed of an α-Cr phase was observed in crystal grains, and the thickness of the α-Cr phase was about 150 nm. In other words, the exhaust valves in the examples described above had a layered structure containing a layer funned of an α-Cr phase grown to a thickness of 150 nm or more in crystal grains, and were in the state of a so-called "overaged".

Figure 7:
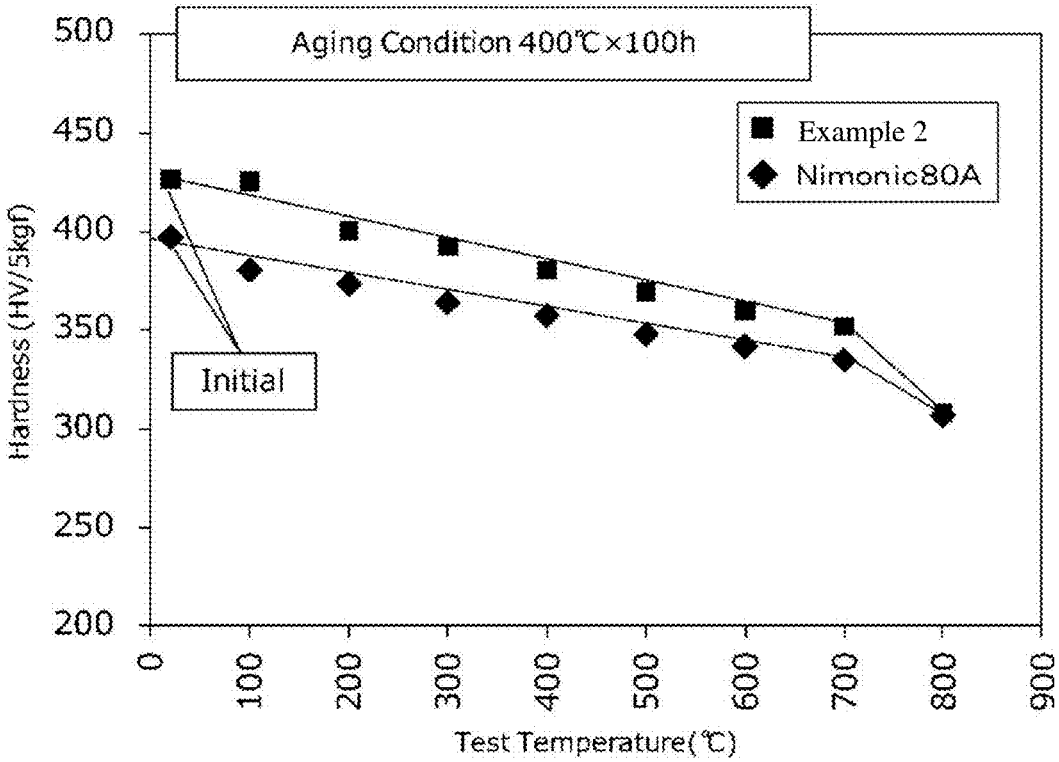
FIG. 7 is a graph showing the result of a high temperature hardness test of an exhaust valve.

As for the exhaust valve of Example 2, a hardness test piece was cut off from the umbrella part 3, and was subjected to a high temperature hardness test. In detail, a plurality of hardness test pieces were cut off from the vicinity of a face surface of the umbrella part 3 of the exhaust valve of Example 2, and they were maintained at 400° C. for 100 hours considering use environment of an exhaust valve, followed by air-cooling. Thereafter, as shown in FIG. 7, the test pieces maintained at the respective test temperatures were subjected to a hardness test. For the sake of comparison, the exhaust valve made of Nimonic 80A was similarly subjected to the hardness test. The hardness test piece of Example 2 showed high temperature hardness equivalent to or more than that of Nimonic 80A at each test temperature. Accordingly, it is understood that the exhaust valve of the present invention can achieve high temperature hardness equivalent to or more than that of Nimonic 80A even after used in an engine for a large ship.

As can be seen from the above-mentioned evaluation test results, according to Examples 1 to 4, it can be obtained the exhaust valve 1 containing the shaft part 2 and umbrella part 3 each having mechanical strength equivalent to or more than that of the exhaust valve made of Nimonic 80A, while securing workability required in working the shaft part 2. Furthermore, the alloy used in the examples is excellent in S attack resistance and V attack resistance as compared with Nimonic 80A, Inconel 718 and Inconel 625, and have a sufficient high temperature corrosion resistance required as an exhaust valve. In other words, an integrated exhaust valve having required mechanical strength and high temperature corrosion resistance can be manufactured without conducting a partial working, for example, increasing hardness only in an umbrella part in the production process. That is, an easily manufacturable engine exhaust valve for a large ship can be obtained.

Component range of an alloy capable of giving and maintaining high temperature corrosion resistance and mechanical strength almost equivalent to those of the alloy used in the exhaust valve 1 in the above evaluation tests can be determined as follows. That is, the alloy may have a component composition containing, in mass %: essential elements of Cr: 32 to 50%, Al: 0.5 to 10.0%, and Fe: 0.1 to 20.0%; optional elements of Si: 5% or less, B: 0.01% or less, C: 0.1% or less, Cu: 5% or less, Ti: 0.1% or less, Nb: 0.1% or less, Ta: 0.1% or less, and V: 0.1% or less, with the proviso that Ti+Nb+Ta+V is 0.1% or less, and the balance being unavoidable impurities and Ni. Cr, Al and Fe that are essential elements are described below.

It is considered that Cr forms an α-Cr phase and increases hardness, and additionally suppresses coarsening of crystal grains. Furthermore, Cr can increase high temperature corrosion resistance such as V attack resistance or S attack resistance in a certain addition range. On the other hand, in the case where Cr is excessively added, forging resistance is too increased to perform forge working. Considering those, Cr may be added in an amount of, in mass %, from 32 to 50%, and preferably from 35 to 45%.

Al is an Ni-system intermetallic compound, forms γ'-phase that is an age-hardening phase contributing to a strengthening mechanism in an Ni-base age-precipitated alloy, and can increase mechanical strength at high temperature. Furthermore, Al can increase high temperature corrosion resistance in a certain addition range. On the other hand, excessive precipitation of γ'-phase accelerates brittleness. Considering those, Al may be added in an amount of, in mass % from 0.5 to 10.0%, and preferably from 3.4 to 5.0%.

Fe is added as a substitute of Ni. Fe accelerates precipitation of a layered structure containing a γ'-phase finely precipitated in the inside of γ-phase, together with α-Cr phase, and can shorten overaging treatment time and aging treatment time. On the other hand, in the case where the amount of Fe added is too large, high temperature corrosion resistance is deteriorated. Therefore, Fe may be added in an amount of, in mass %, from 0.1 to 20.0%, and preferably from 0.5 to 5%.

The alloy may contain Si, B, C, Cu, Ti, Nb, Ta and V that are optional elements as described below.

Similar to Al, Si forms a particulate metal intermetallic compound giving influence to mechanical strength at high temperature, and can additionally improve corrosion resistance at high temperature. On the other hand, excessive precipitation of an intermetallic compound phase induces brittleness. Therefore, Si may be added in an amount of in mass %, 5% or less, and preferably 3.5% or less.

B gives influence to mechanical strength of a grain boundary. In the present invention, B may be added in an amount of, in mass %, 0.01% or less, and preferably 0.005% or less.

C gives influence to corrosion resistance at high temperature, allows to precipitate a carbide between C and a predetermined element described below, and can give influence to mechanical strength. In the present invention, C may be added in an amount of, in mass %, 0.1% or less.

Cu dissolves in an γ-phase and gives influence to mechanical strength. In the present invention, Cu may be added in an amount of, in mass %, 5% or less, and preferably 1% or less.

Each of Ti, Nb, Ta and V bonds to C to form a carbide, gives influence to mechanical strength, and additionally gives influence to corrosion resistance at high temperature. It is preferred that Ti is added in an amount of, in mass %, 0.1% or less, Nb is added in an amount of, in mass %, 0.1% or less, and Ta is added in an amount of, in mass %, 0.1% or less, V is added in an amount of, in mass %, 0.1% or less, with the proviso that Ti+Nb+Ta+V is 0.1% or less.

Although the present invention has been described in detail and by reference to the specific embodiments, it is apparent to one skilled in the art that various modifications or changes can be made without departing from the spirit and scope of the present invention.

The present application is based on Japanese Patent Application No. 2015-012257 filed on Jan. 26, 2015 and on Japanese Patent Application No. 2015-203272 filed on Oct. 14, 2015, which contents are incorporated herein by reference.

DESCRIPTION OF REFERENCE NUMERALS AND SIGNS

1: Exhaust valve
2: Shaft part
3: Umbrella part

What is claimed is:

1. A method for manufacturing an exhaust valve of a diesel engine for a ship, the exhaust valve comprising a shaft part and an umbrella part that are integrated with each other and include an Ni—Cr—Al system Ni-base age-precipitated alloy, wherein the method comprises:

vacuum melting a raw material to obtain a steel ingot;

obtaining a billet for a forge working from the steel ingot;

subjecting the billet to an aging heat treatment to form an overaged state so as to give a layered structure containing a layer including an α-Cr phase having a thickness of 150 nm or more;

forge-working the billet in an integrated state of the shaft part and the umbrella part; and an adjusting heat treatment to provide a hardness of 600 HV or less as a whole while maintaining the thickness of the layer formed of the α-Cr phase, wherein the vacuum melting, the obtaining the billet, and the aging heat treatment are conducted while maintaining a temperature to at least 600° C. or higher, and wherein the alloy includes a component composition comprising, in mass %:

essential elements of:

Cr: 32% to 50%,

Al: 0.5% to 10.0%; and

Fe: 0.1% to 20.0%;

optional elements of:

Si: 5% or less;

B: 0.01% or less;

C: 0.1% or less;

Cu: 5% or less;

Ti: 0.1% or less;

Nb: 0.1% or less;

Ta: 0.1% or less; and

V: 0.1% or less, with a proviso that Ti+Nb+Ta+V is 0.1% or less; and a balance being unavoidable impurities and Ni.

2. The method for manufacturing an exhaust valve according to claim 1, wherein the obtaining the billet comprises subjecting the steel ingot to a pre-rolling, to a hot surface grinding, and then to a main rolling.

3. An exhaust valve of a diesel engine for a ship, the exhaust valve comprising:

a shaft part and an umbrella part that are integrated with each other and include an Ni—Cr—Al system Ni-base age-precipitated alloy, wherein the exhaust valve is obtained by the manufacturing method described in claim 2, and includes a layered structure and a hardness of 600 HV or less as a whole.

4. The method for manufacturing an exhaust valve according to claim 1, wherein the obtaining the billet comprises a heat equalizing treatment of maintaining the steel ingot at 1,100° C. or higher for 10 hours or more.

5. The method for manufacturing an exhaust valve according to claim 4, wherein the obtaining the billet is conducted while maintaining the temperature at 800° C. or higher.

6. An exhaust valve of a diesel engine for a ship, the exhaust valve comprising:

a shaft part and an umbrella part that are integrated with each other and include an Ni—Cr—Al system Ni-base age-precipitated alloy, wherein the exhaust valve is obtained by the manufacturing method described in claim 5, and includes a layered structure and a hardness of 600 HV or less as a whole.

7. An exhaust valve of a diesel engine for a ship, the exhaust valve comprising:

a shaft part and an umbrella part that are integrated with each other and include an Ni—Cr—Al system Ni-base age-precipitated alloy, wherein the exhaust valve is obtained by the manufacturing method described in claim 4, and includes a layered structure and a hardness of 600 HV or less as a whole.

8. The method for manufacturing an exhaust valve according to claim 1, wherein the obtaining the billet is conducted while maintaining the temperature at 800° C. or higher.

9. An exhaust valve of a diesel engine for a ship, the exhaust valve comprising:

a shaft part and an umbrella part that are integrated with each other and include an Ni—Cr—Al system Ni-base age-precipitated alloy, wherein the exhaust valve is obtained by the manufacturing method described in claim 8, and includes a layered structure and a hardness of 600 HV or less as a whole.

10. An exhaust valve of a diesel engine for a ship, the exhaust valve comprising:

a shaft part and an umbrella part that are integrated with each other and include an Ni—Cr—Al system Ni-base age-precipitated alloy, wherein the exhaust valve is obtained by the manufacturing method described in claim 1, and includes a layered structure and a hardness of 600 HV or less as a whole.

* * * * *